US006488613B1

(12) United States Patent
Domenge

(10) Patent No.: US 6,488,613 B1
(45) Date of Patent: Dec. 3, 2002

(54) INERTIAL EXERCISER DEVICE, METHOD OF ASSEMBLY, AND METHOD OF EXERCISING THEREWITH

(76) Inventor: Alberto G. Domenge, Fuente de las Aguilas #194, Tecamachalco (MX), 53950

( * ) Notice: Subject to any disclaimer, the term of this patent is extended or adjusted under 35 U.S.C. 154(b) by 0 days.

(21) Appl. No.: 09/711,529

(22) Filed: Nov. 14, 2000

(51) Int. Cl.[7] ..... A63B 21/22
(52) U.S. Cl. ..... 482/110; 482/148
(58) Field of Search ..... 482/110, 104–108

(56) References Cited

U.S. PATENT DOCUMENTS

| | | | | |
|---|---|---|---|---|
| 2,821,394 A | | 1/1958 | Barbeau | |
| 3,403,906 A | | 10/1968 | Burzenski | |
| 3,482,835 A | | 12/1969 | Dean | |
| 3,708,164 A | | 1/1973 | Griffin | |
| 3,796,431 A | * | 3/1974 | Sinyard | 272/84 |
| 3,809,393 A | | 5/1974 | Jones | |
| 4,043,553 A | * | 8/1977 | Suarez | 272/128 |
| 4,150,580 A | | 4/1979 | Silkebakken et al. | |
| 4,171,805 A | | 10/1979 | Abbott | |
| 4,513,963 A | | 4/1985 | Nelson et al. | |
| 4,703,928 A | | 11/1987 | Escher | |
| 4,714,246 A | | 12/1987 | Parisien | |
| 4,775,147 A | | 10/1988 | Bold, Jr. | |
| 4,900,017 A | | 2/1990 | Bold, Jr. | |
| 5,046,727 A | | 9/1991 | Wilkinson et al. | |
| 5,163,888 A | | 11/1992 | Stearns | |
| 5,244,445 A | | 9/1993 | Amesquita | |
| 5,304,108 A | | 4/1994 | Denega et al. | |
| 5,643,162 A | | 7/1997 | Landers et al. | |
| 5,707,325 A | | 1/1998 | Chiou | |

* cited by examiner

*Primary Examiner*—Michael A. Brown
*Assistant Examiner*—Lori Baker Amerson
(74) *Attorney, Agent, or Firm*—Greenblum & Bernstein, P.L.C.

(57) ABSTRACT

A method of exercizing, various exercize devices and a method of assembling the exercizer devices. The exercise device includes at least one weight system comprising at least a first weight and a second weight, the first and second weights being rotatably mounted, at least one chamber for at least partially enclosing the weight system, and at least one mechanism for allowing a user to grip the inertial exercizer. A method of exercizing provides for gripping the exerciser with at least one hand, and moving the exercizer in at least one direction. A method of assembling an inertial exerciser, includes installing the at least one first weight and the at least one second weight into the at least one chamber, and attaching the at least one mechanism to the at least one chamber.

49 Claims, 12 Drawing Sheets

INERTIAL EXERCISER DEVICE, METHOD OF ASSEMBLY, AND METHOD OF EXERCISING THEREWITH

BACKGROUND OF THE INVENTION

1. Field of the Invention

The present invention relates to exercise devices, which utilize the principle of inertia to amplify the exercise performed with such devices and, more particularly, to devices which utilize an eccentric weight rigidly fixed at the outer end of a rod rotatably articulated to an axle provided with handles.

2. Discussion of Background Information

The public, young and old, have become more and more aware of the benefits of exercising, which have presently become almost axiomatic. One reason for this is because exercising translates into a healthier and longer life. Additionally, exercising and being fit is no longer a question of looks, it is a matter of having a better quality of life. As a result, the types of machines and exercising devices that have appeared on the market have multiplied greatly to the point that it is difficult to provide an exhaustive description or classification of such devices. However, in general, such exercising devices may be characterized as being bulky, complicated and expensive. Other common features of most of these conventional exercising devices are that their use is often monotonous and even extremely boring. Accordingly, there exists a need for an inertial exerciser which has at least some of the following advantages: simplicity in its mechanical structure; high reliability; low cost; small size; and fun to use. Moreover, such a device should also offer to the user the challenge of becoming more and more proficient in executing the numerous, varied and beneficial exercises which can be performed with the device.

One type of conventional inertial exerciser utilizes eccentric weights. Some selected patents illustrating this type of exerciser are the following: U.S. Pat. No. 4,714,946; 4,513,963 and 4,043,553.

U.S. Pat. No. 4,714,246 discloses a disk provided with two diametrically opposed handles. A resilient ball is tethered to the center of the disk by a flexible, but substantially inelastic line, the line being slightly shorter than the radius of the disk. Weights may be attached to the device. Proper flexions and extensions of the arms or of other parts of the user's body set the ball in a periodic bouncing motion. The rhythm thus established regulates the various exercises of the user.

U.S. Pat. No. 4,513,963 discloses a body exercise apparatus which includes a tubular member having a length significantly greater than the width of a person's shoulders with bearings disposed within the tubular member adjacent the ends thereof. A bar member is disposed within the tubular member along the axis thereof, the ends of the bar member extending through and beyond the bearings and connector sections associated with the exposed end sections of the bar member. Each of the connector sections includes at least one opening, the opening being of a size slightly larger than the cross section of the exposed bar member end section. A weight is permanently affixed adjacent the opposite end of each connector section, the exposed bar member end section being engageable with the connector section opening. A fastener secures each connector section to an exposed bar member end section in an orientation substantially perpendicular to the tubular member, and a protective covering is disposed over the weight, the connector sections and at least a portion of the tubular member.

U.S. Pat. No. 4,043,553 discloses an exercise device for improving muscular tone, primarily of the upper torso and arms. Circular motion is imparted to a pair of hand grips rotatably secured to an eccentrically weighted cross shaft. Sufficient tolerance is provided between the cross shaft and the hand grips so that the cross shaft is free to move in an orbital path eccentric to the center of the hand grips, wherein the orbital movement of the hand grips and the eccentric orbital movement of the cross shaft may be utilized to exercise various muscles of the body.

Other conventional exercise devices are discussed below.

U.S. Pat. No. 3,796,431 discloses an exercising device in the form of a dumbbell. The device is provided with rotatable spherical weights, which allow the device to be used by being rolled along a flat surface such as a floor or wall, in addition to being used by lifting the device in a conventional manner.

U.S. Pat. No. 4,900,017 is a device similar to that described above, in which an inertial force exercise device includes a wheel member operable to engage and roll on a surface during an exercise routine. An axle member extends in a predetermined manner so as to be controlled by an operator of the device. An inertial mass structure is connected to the axle for translation with the axle, without rotation with respect to the axle, for providing an inertial resistance through non-rotational translation so as to exercise a user's body. Due to the mass of the device, a substantial linear inertia is produced.

U.S. Pat. No. 4,150,580 discloses a hand-held ball shaped case having a shaft mounted inertial wheel or rotor provided with fins. The casing leaves part of the rotor exposed, so that an initial spin can be imparted to it. Afterwards, the rotor spins so that it is maintained by imparting a periodic motion thereto. The device is basically a gyroscope with a race designed for providing smooth rotor movement.

U.S. Pat. No. 3,809,393 discloses an exercise device having a handle supported by at least three swivel casters. The device can be moved about a floor. However, this device does not appear to truly be an inertial exercise device as it does not produce inertial resistance to the movement imparted to the device by a user.

U.S. Pat. No. 4,775,147 is an inertial exercise device having three independent rotational inertial systems. A plurality of wheel and axle elements cooperate with weight elements so that rolling of the devices produces an inertial force. The device appears to be for floor-type exercise and is directed to an open-type, non-protected weight element for providing the inertial force when initially moved by a user.

U.S. Pat. No. 4,171,805 is directed to a rollable hand held exercise device that requires an additional, stationary element to provide a rolling surface. The device is not a true inertial-type exercise device as it requires a special surface to provide rolling contact surfaces which the user must use in conjunction with the weights so as to guide the weights in a manner designed to force certain muscle groups to work.

U.S. Pat. No 5,046,727 is a wrist exercise device having a hollow shaft which houses a spring element. Tension disks are connected to the springs so that the disks can be moved toward and away from each other by turning a tension adjusting knob at ends of the device.

U.S. Pat. No. 5,643,162 discloses an exercise apparatus which is used in a forward and/or lateral movement in an extension type of exercise. While rolling and/or sliding of the device is considered, inertial exercise is not truly disclosed. This is an example of a low-friction type exercise device that, on its surface, may appear to be an inertial exercise device. However, it is apparent that low-friction type exercise does not imply an inertial exercise element.

U.S. Pat. No. 5,707,325 discloses an exercise device relating to a roller type device. The exerciser includes a roller for rolling along a first direction from a first position. Intermediate positions are defined as the device proceeds from the first position to the final position. The route of the device is then repeated back to the start position. Energy storing devices are provided to effect movement from one position to another. The energy storing devices are springs which are contracted and released as the device moves from one position to another.

U.S. Pat. No. 5,163,858 discloses an exercising apparatus in which different linkages are moved in response to movement of a user. The movements of the various links function to provide a resistance against which the user must work.

U.S. Pat. No. 5,304,108 discloses a resist and assist exercising device. The device allows the user to impart movement to the exercise device alone a particular direction and the user may continue the application of force in that direction. Alternatively, the user may resist the force imparted in the first direction by trying to impart force thereto in another direction. However, while the exerciser is of the assist/resist type, the device operates by use of an essentially weightless mass. Thus, it is not a true inertial type exercise device.

U.S. Pat. No. 3,403,906 discloses an exerciser with grippers mounted on a shaft. This exerciser is again a roller type exercise device which does not require the user to work against an inertia imparted to the device by the user.

U.S. Pat. No. 3,708,164 discloses a manual torsion exerciser in which a torsional member is positioned within a tubular member and extends from the outer end part of one tubular member to the outer end part of another tubular member. A retainer member is releasably engaged with one end of the torsional member so that the torsional member is placed under torsional stress upon rotation of one tubular member relative to the other tubular member.

U.S. Pat. No. 2,821,394 discloses a spring-roller type exercise device in which the device is rolled on a floor so as to cause the user to impart force to a coil-type spring. Movement of the exerciser back and forth along the floor coils and uncoils the spring, forcing the user to work against the spring force in a coiling and uncoiling mode.

U.S. Pat. No. 4,703,928 discloses a precessional exercise device designed only for foot exercises. A spinning mass forms the rotor of a motor for spinning the mass. Rotational movement of the foot is opposed by a gyroscopic effect produced by the spinning mass. This produces an isometric exercise effect when the foot is rotated while the torque of the spinning mass is opposed by other muscles of the foot.

U.S. Pat. No. 5,944,445 discloses an exercise wand. The wand has a hollow rigid tube having a length sufficient to extend a substantial distance to either side of the body median plane. A plurality of spheres are enclosed in the hollow wand. Movement in one direction causes the spheres to roll in the wand from end to end and add momentum to the movement so as to provide an extra push to the movement of the body.

U.S. Pat. No 3,482,835 discloses a barbell with an eccentric weight. Movement of the barbell causes a force to be imparted to the weight so that it rotates eccentrically about the shaft of the barbell. The device uses the effects of centrifugal force to require the user to coordinate his/her movement of the barbell with the movement of the eccentric weight.

The foregoing devices are of different types and are designed to produce different results. Each type of exercise device has its own advantages and disadvantages. However, all of these known exercising devices have at least one common disadvantage. That is, they do not utilize the effects of inertia to permit a user to first impart movement to an exercise device and then work against the imparted movement in a variety of ways so as to provide a complete workout for a user or a team of users. The foregoing devices require the use of, among others, tension springs, compression springs, eccentrically mounted weights, offset shafts, etc., all of which unnecessarily complicate such exercising devices and necessarily lead to an increased cost of manufacture and a consequent increased cost to the consumer.

SUMMARY OF THE INVENTION

The invention of the present application was developed to overcome the problems of known exercising devices. More particularly, the invention was designed to provide an inertial exercise device that is effective in promoting healthy exercise with a minimum of stress to the muscle groups so as to thereby avoid injuries often associated with exercise. In addition, the inertial exercise device of the present invention relies on a simple, though ingenious, design for coaxing a maximum workout from a user while at the same time permitting the user to enjoy the workout.

Accordingly, the invention provides for an inertial exerciser including at least one weight system comprising at least a first weight and a second weight, the first and second weights being rotatably mounted, at least one chamber for at least partially enclosing the weight system, and at least one mechanism for allowing a user to grip the inertial exerciser. The mechanism for gripping may comprise at least one handle. The first and second weights may comprise a partial spherical shape. The first and second weights may be rotatably mounted to an axle. The first and second weights may be attached to the axle via respective first and second connecting bars. The first connecting bar may be coupled to the axle via a yoke and the second connecting bar may be coupled to the axle via a spigot.

The exerciser may further comprise at least one bushing disposed between at least one of the axle and the yoke and the axle and the spigot. The exerciser may further comprise at least one thrust bushing disposed on the axle adjacent at least one of the yoke and the spigot. One of the first and second connecting bars may be adjustable. The chamber may further comprise a circular bowl shaped casing. The chamber may further comprise a circular shaped cover. The mechanism for allowing a user to grip the inertial exerciser may further comprise a first handle positioned on one side of the exerciser and a second handle positioned on another side of the exerciser. The first and second handles may be secured to the exerciser via at least two handle rods which are attached to the exerciser. One of the first and second handles may comprise at least one handle screw which is adapted to engage at least one handle rod. One of the first and second handles may be removable from the exerciser. The weight system may be secured to the chamber via at least one threaded connection. The weight system may also comprise an axle which is secured to the chamber via at least one threaded connection. The mechanism for gripping may comprise a bar. The first and second weights may be rotatably mounted to a bar. The mechanism for gripping may comprise the bar. The exerciser may further comprise first and second retaining members disposed on the bar for axially retaining the at least one chamber on the bar.

The invention also provides for an inertial exerciser including a bar, at least one weight system comprising at least a first weight and a second weight, the first and second weights being rotatably mounted on the bar, and at least one chamber for at least partially enclosing the weight system, wherein the bar is adapted to allow a user to grip the inertial exerciser. The exerciser may further comprise at least one gripping sleeve disposed on the bar. The bar may comprise a textured gripping surface. The first and second weights may be attached to the bar via respective first and second connecting bars. The first connecting bar may be coupled to the bar via a yoke and the second connecting bar may be coupled to the bar via a spigot. The exerciser may further comprise at least one bushing disposed between at least one of the bar and the yoke and the bar and the spigot. The exerciser may further comprise at least one thrust bushing disposed on the bar adjacent at least one of the yoke and the spigot. One of the first and second connecting bars may be adjustable. The chamber may further comprise a circular bowl-shaped casing. The chamber may further comprise a circular cover. The bar may further comprise a first handle end on one side of the exerciser and a second handle end on another side of the exerciser.

The exerciser may further comprise first and second retaining members disposed on the bar for axially retaining the at least one chamber on the bar. The exerciser may farther comprise at least one weight disposed on the bar and adjacent the chamber.

The invention also provides for a method of exercising using an inertial exerciser which comprises at least one weight system including at least a first weight and a second weight, the first and second weights being rotatably mounted, at least one chamber for at least partially enclosing the weight system, and at least one mechanism for allowing a user to grip the inertial exerciser. Accordingly, the method may include gripping the exerciser with at least one hand, and moving the exerciser in at least one direction.

According to another aspect of the invention, there is provided a method of exercising using an inertial exerciser which comprises a bar, at least one weight system comprising at least a first weight and a second weight, the first and second weights being rotatably mounted on the bar, and at least one chamber for at least partially enclosing the weight system, the bar being adapted to allow a user to grip the inertial exerciser. Accordingly, the method includes gripping the bar with at least one hand, and moving the exerciser in at least one direction.

According to another aspect of the invention, there is provided an inertial exercise device endowed with two connecting rods, having each a first and a second end. At their first ends, the connecting rods are rotatably mounted to a common central axle, in which they can spin in the same plane of rotation. At their second end or extremity, the connecting rods are provided with eccentric equal and incompressible weights, preferably solid spheres or balls. The eccentric weights may have a radius of the same length. The central axle may be provided with flanking circular plates or disks that serve to secure a transparent plastic protective casing that fully covers all the moving parts of the exerciser. The disks may serve to rigidly mount over them one or several lateral handles. These may be used to protect the user and persons nearby against possible injuries caused by accidentally being hit by the fast moving distal eccentric balls, while the inertial exerciser is being used.

An exercise may be performed, in a first mode of operation, by actuating the inertial exerciser with a reciprocating motion which is tangential to the plane of oscillation of the connecting rods and their distal eccentric weights. Operating the inertial exerciser in this manner, causes the connecting rods and their eccentric balls or weights, to get into a repetitive cycle. As a result, they oscillate in opposite directions until the balls reach a colliding point, then they change their sense of oscillation until the balls or weights collide again, changing their sense of rotation, and so on. Alternatively, in another mode of operation, the inertial exerciser can be actuated orbitally, that is with a substantial continuous circular motion. In this mode of operation, the connecting rods with distal eccentric weights also spin with a continuous circular motion.

The protective casing completely surrounding the moving parts of the exerciser also serves to abate the intensity of noise produced by the continual collisions of the inertial balls, while the exerciser is operated with a linear reciprocating motion, as explained above.

Thus, one object of the invention is to provide an inertial exerciser with two equal connecting rods rotatably articulated in one end to a common central axle integral to lateral disks provided with side by side handles. The connecting rods are provided in their outer end with eccentric weights, preferably substantially spherical, with the connecting rods and their eccentric weights being capable of or oscillating and colliding when a reciprocating motion is applied to the inertial exerciser. Additionally, the weights are designed to collide with one another periodically at the end of each oscillating stroke.

Another object of the invention is to provide an inertial exerciser capable of being operated at any "attitude" or incline angle (with respect to the position of the user) imparting to it by the user a linear or circular reciprocating motion.

Another object is to provide an inertial exerciser capable of being operated by imparting to it a substantially circular continuous motion, in which case the connecting rods and their eccentric weight also move, without colliding, with a circular continuous motion.

Another object of the invention is to provide an inertial exerciser, as described above, with an external preferably transparent plastic casing that serves to isolate the moving parts of the exerciser, preventing possible injuries to the user or others nearby.

Another object of the invention is to provide an inertial exerciser, comprising a plurality of exercise sets, as described above, the sets being mounted over a common rod for each pair of connecting rods endowed with eccentric weights. In this manner, one or more inertial exercising units can be mounted over a common bar. The bar may be short or long and the set of inertial exercising units may have a shape quite similar in manner to that of a dumbbell or a barbell.

Another object of the invention is to furnish an inertial exerciser provided with an external casing, so as to lessen the noise produced by the moving parts of the exerciser. This is particularly necessary when the inertial exerciser is used by imparting to it a reciprocating motion and the eccentric weights of the rotatably articulated connecting rods are caused to continuously collide with one another.

Another object of the invention is to furnish an inertial exerciser with side by side disks in which up to three handles may be rigidly attached, so that the exerciser may be operated with one or two hands or by one or two users at the same time.

Another object of the invention is to furnish the shaft of an inertial exerciser with a rotatably inserted tube or tubes so that the external casino or casinos can be rolled over the floor or any preferably flat and horizontal surface imparting to it a linear reciprocating motion.

Another object of the invention is to furnish an inertial exerciser with standard weights which can be mounted as needed by the ends of its central bar between the external casing and the lateral supports.

According to one aspect of the invention, there is provided an inertial exerciser which is characterized by the novel feature that it is provided with two rods rotatably articulated to a common axle in such a way that they can both rotate on the same rotational plane, each rod having at their other end, a rigidly attached weight, preferably having the shape of a truncated sphere. The movable parts, the rods and their eccentric weights, are enclosed in an external casing, preferably made of transparent plastic. The inertial exerciser has lateral handles and can be grasped with one or both hands, by one or two persons.

When a substantially vertical or horizontal, linear or circular reciprocating movement is imparted to the exerciser, the eccentric weights are caused to repeatedly oscillate and collide and bounce with one another, changing their sense of oscillation. Alternatively, when the exerciser is operated with a substantially continuous circular movement, the eccentric weights and rods rotate about their common axle. A set of one or more inertial exercisers, as described above, can be mounted over a common bar. Furthermore, the inertial exerciser is provided with a circular external casing that may also be used to roll the exerciser over a flat surface.

In another form of the invention, one or several sets of bars with an eccentric weight at their external end may be rotatably articulated to a common axle or central shaft, that also serves as a handle. In particular, two such sets may be mounted symmetrically by the extremes of the shaft, that may be relatively shorter or longer, so as to be grasped with one or both hands respectively.

One or several portions of the shaft may be further provided with a tube of a slightly larger diameter than that of the shaft, the tube being rotatably inserted into the shaft.

The inertial exercisers provided with such tube or tubes, may additionally be rolled on a preferably horizontal or slanting flat surface. In all cases, the movable parts are enclosed by an external casing that serves to protect the user or people nearby of possible injury caused by the moving parts and to reduce the noise produced by the collision or the eccentric weights, as explained above. In another form of the invention, the inertial exerciser is provided with a central shaft on which conventional weights can be mounted.

The invention also provides for a method of assembling an inertial exerciser, which includes at least one weight system comprising at least a first weight and a second weight, the first and second weights being rotatably mounted, at least one chamber for at least partially enclosing the weight system, arid at least one mechanism for allowing a user to grip the inertial exerciser. The method comprises installing the at least one first weight and the at least one second weight into the at least one chamber, and attaching the at least one mechanism to the at least one chamber. The method may further comprise rotatably mounting the first and second weights on an axle. Furthermore, the method may comprise connecting the first and second weights to the axle via respective first and second connecting bars. Additionally, the first connecting bar may be coupled to the axle via a yoke and the second connecting bar may be coupled to the axle via a spigot. The method may further comprise installing at least one bushing between at least one of the axle and the yoke and the axle and the spigot. Further, at least one thrust bushing may be installed on the axle adjacent at least one of the yoke and the spigot. The attaching may comprise positioning a first handle on one side of the exerciser and a second handle on another side of the exerciser.

The invention further contemplates an inertial exerciser, comprising an axle, at least one weight system comprising at least a first weight and a second weight, the first and second weights being rotatably mounted on the axle, the first and second weights comprising a partially spherical shape and being attached to the axle via respective first and second connecting bars, the first connecting bar being coupled to the axle via a yoke and the second connecting bar being coupled to the axle via a spigot, at least one chamber for at least partially enclosing the weight system, and at least one handle for allowing a user to grip the inertial exerciser.

The invention also contemplates a method of assembling an inertial exerciser, which includes at least one weight system comprising at least a first weight and a second weight, the first and second weights being rotatably mounted, at least one chamber for at least partially enclosing the weight system, and at least one mechanism for allowing a user to grip the inertial exerciser, the method comprising installing the at least one first weight and the at least one second weight into the at least one chamber, attaching the at least one mechanism to the at least one chamber, rotatably mounting the first and second weights on an axle, connecting the first and second weights to the axle via respective first and second connecting bars, and coupling the first connecting bar to the axle via a yoke and coupling the second connecting bar to the axle via a spigot.

The above-mentioned exclusive and novel features of the inertial exerciser of this invention dramatically multiply the number of beneficial workouts that can be performed. The sustained enjoyment derived while executing exerciser with this inertial exerciser and the challenge of becoming more proficient, are powerful motivations to keep on using the exerciser longer and more frequently.

BRIEF DESCRIPTION OF THE DRAWINGS

The present invention is further described in the detailed description which follows, with reference to the plurality of drawings by way of non-limiting examples of preferred embodiments of the present invention. In the drawings, like reference numerals represent similar parts throughout the several views of the drawings, and wherein.

DETAILED DESCRIPTION OF THE PRESENT INVENTION

The particulars show herein are by way of example and for purposes of illustrative discussion of the embodiments of the present invention only and are presented in the cause of providing what is believed to be the most useful and readily understood description of the principles and conceptual aspects of the present invention in no more detail than is necessary for the fundamental understanding of the present invention, the description taken together with the drawings making apparent to those skilled in the art how the several forms of the present invention may be embodied in practice.

Figure 1:
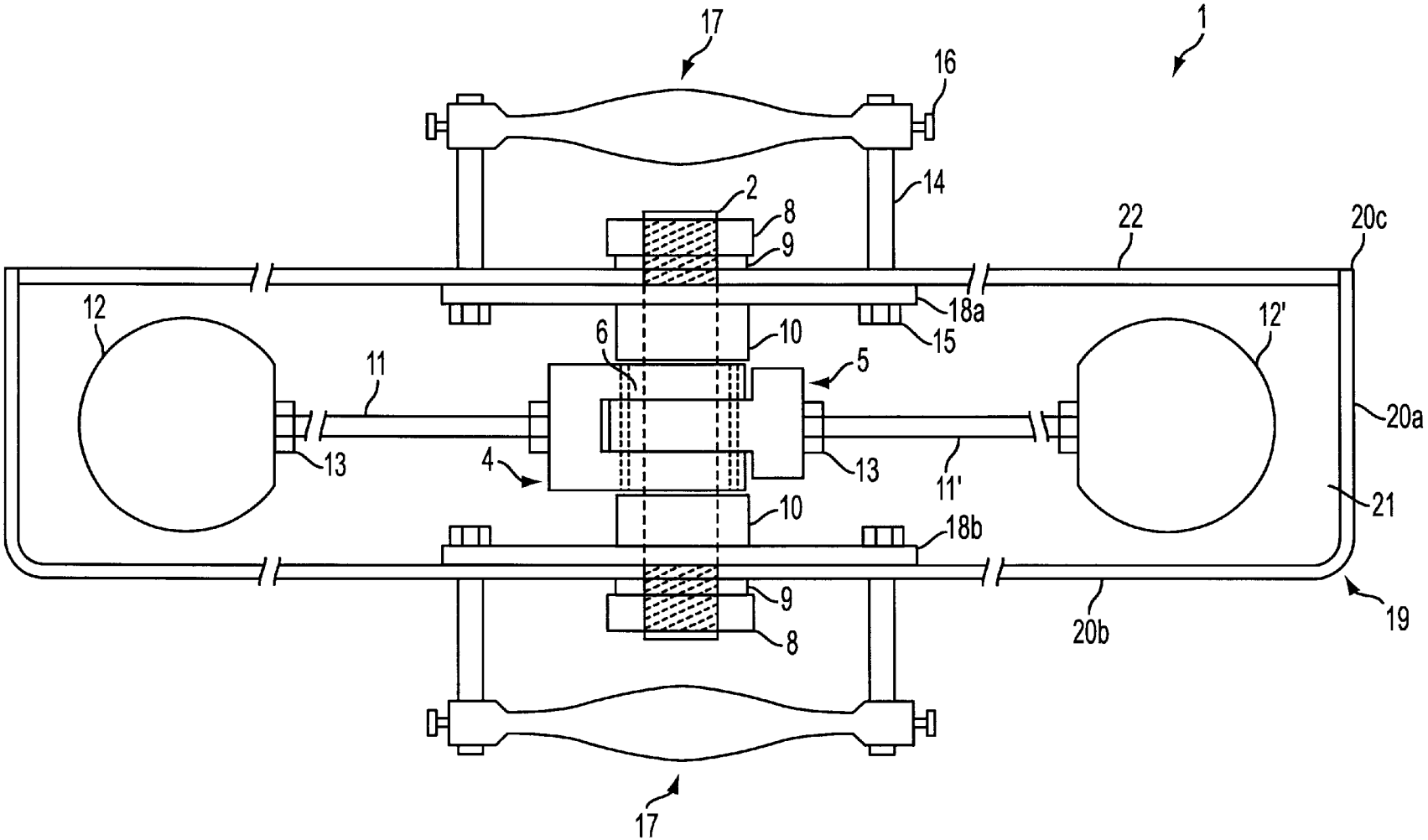
FIG. 1 shows one embodiment of an exerciser having a central axle and two external handles.

FIG. 1 illustrates one embodiment of an exerciser according to the present invention. Exerciser I includes a two part housing in which one part forms a casing body 19. Casing body 19 has a circular shape and includes an outer wall section 20*a* which is integrally formed with a side wall section 20*b*. Moreover, outer wall section 20*a* has an outerwall edge 20*c*. Of course, these wall sections 20*a*, 20*b* need not be integrally formed but may also be formed separately and thereafter attached to each other via screws, bonding, welding, or other conventional attachment techniques. It should be noted that casing body 19 may be made of metal, plastic, a composite material, or any convenient material which is suitable for the purpose of housing the weight system (e.g., elements 4, 5 and 11–13), with the casing body defining a housing recess or chamber 21 which at least partially encloses the inertial weight system.

Figure 19:
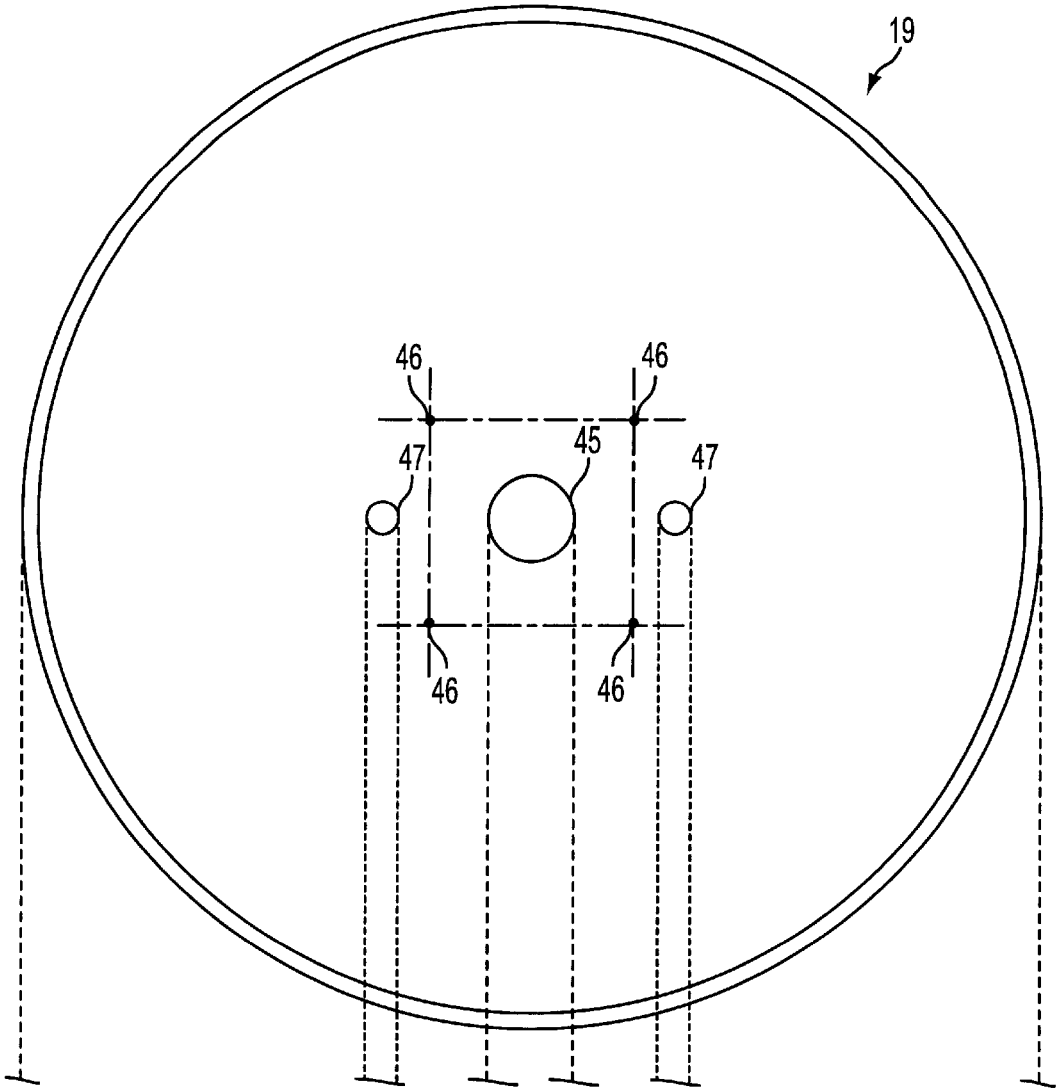
FIG. 19 shows a top view of a casing body having four bores, two handle bores, and a central bore, used in the embodiment of FIG. 1.
Figure 20:
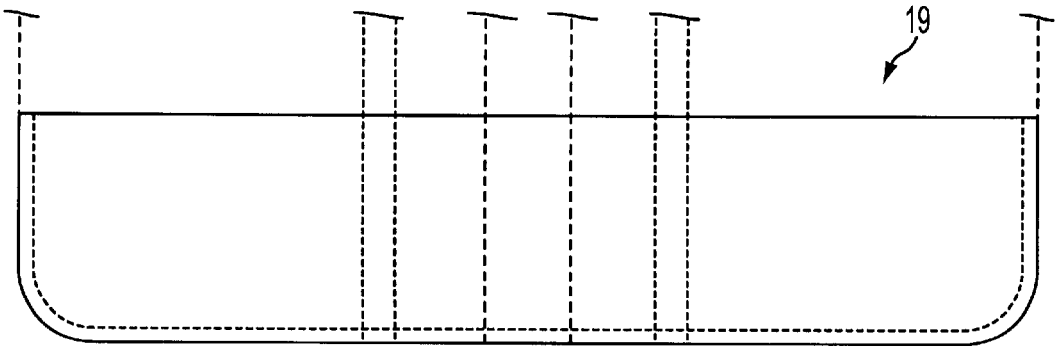
FIG. 20 shows a simplified lateral side view of a casing body shown in FIG. 19.

As shown in FIGS. 19 and 20, casing body 19 has four through apertures 46 which are symmetrically arranged around a central opening 45. Arranged along a center line extending through central opening 45, are two handle rod openings 47.

Referring back to FIG. 1, the exerciser also includes a cover 22 which defines a second side wall section arranged substantially parallel to the first side wall section 20*b*. Cover 22 has a circular shape which is smaller than an inside diameter of the outer wall section 20*a*. As with the casing body, cover 22 may be made of metal, plastic, a composite material, or any convenient material which is suitable for the purpose of housing the weight system. Of course, it is not critical that cover 22 fit within recess 21. The invention contemplates other casing designs, e.g., such as one wherein cover 22 has a lip with an inner diameter which is larger than an outer diameter of the of outer wall section 20*a*. In yet another design possibility, casing 19 and cover 22 may be replaced with a casing design utilizing two similarly shaped oppositely facing casings 19 wherein outer wall edges 20*c* of each casing face one another, e.g., defining a clam shell type casing.

Figure 18:
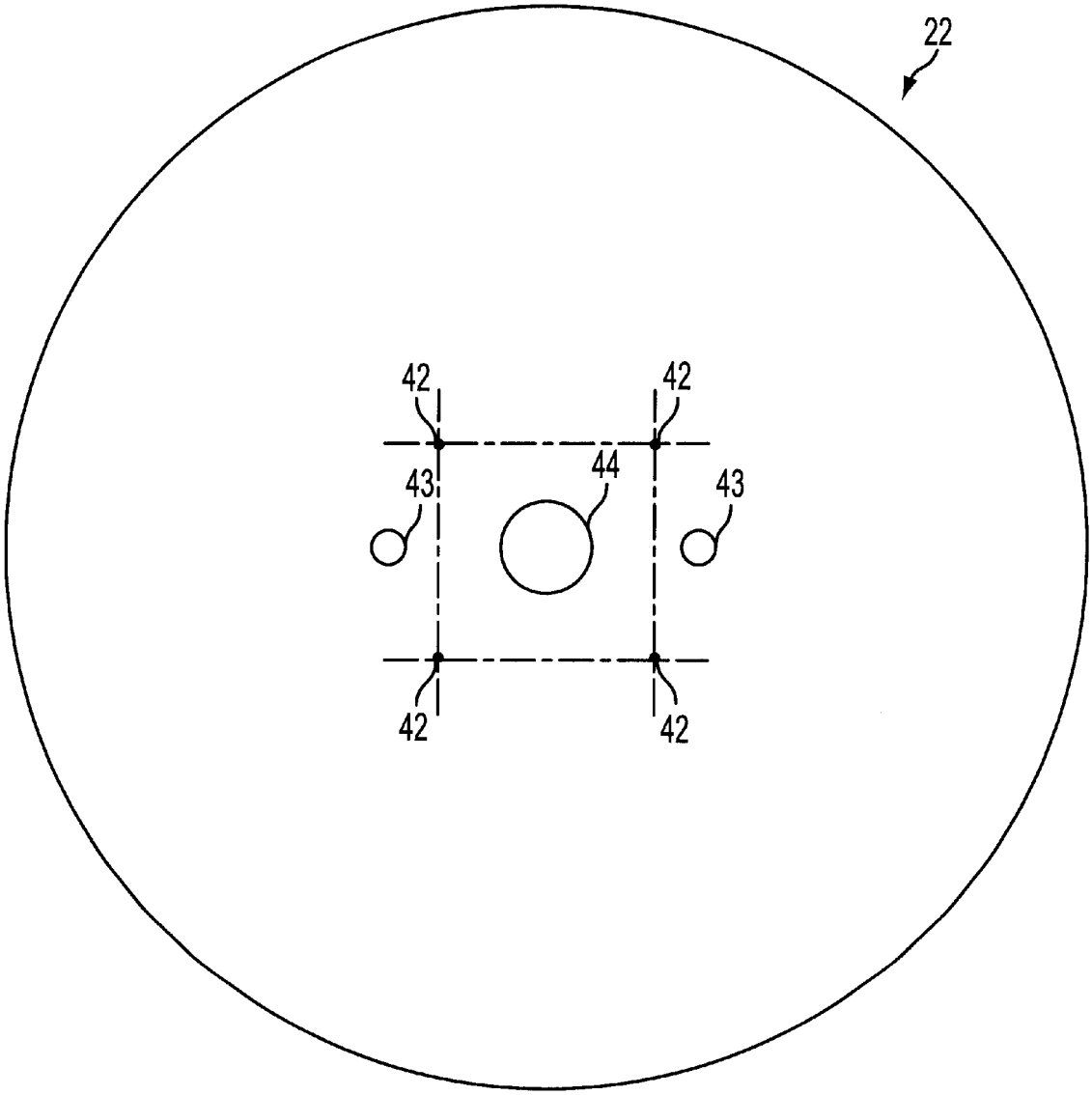
FIG. 18 shows a top view of a cover or top having screw bores, handle support rod bores, and a central bore, used in the embodiment of FIG. 1.

As shown in FIG. 18, cover 22 has four through apertures 42 which are symmetrically arranged around a central opening 44. Arranged along a center line extending through central opening 44, are two handle rod openings 43. These openings preferably also correspond to the openings 45–47.

Figure 12:
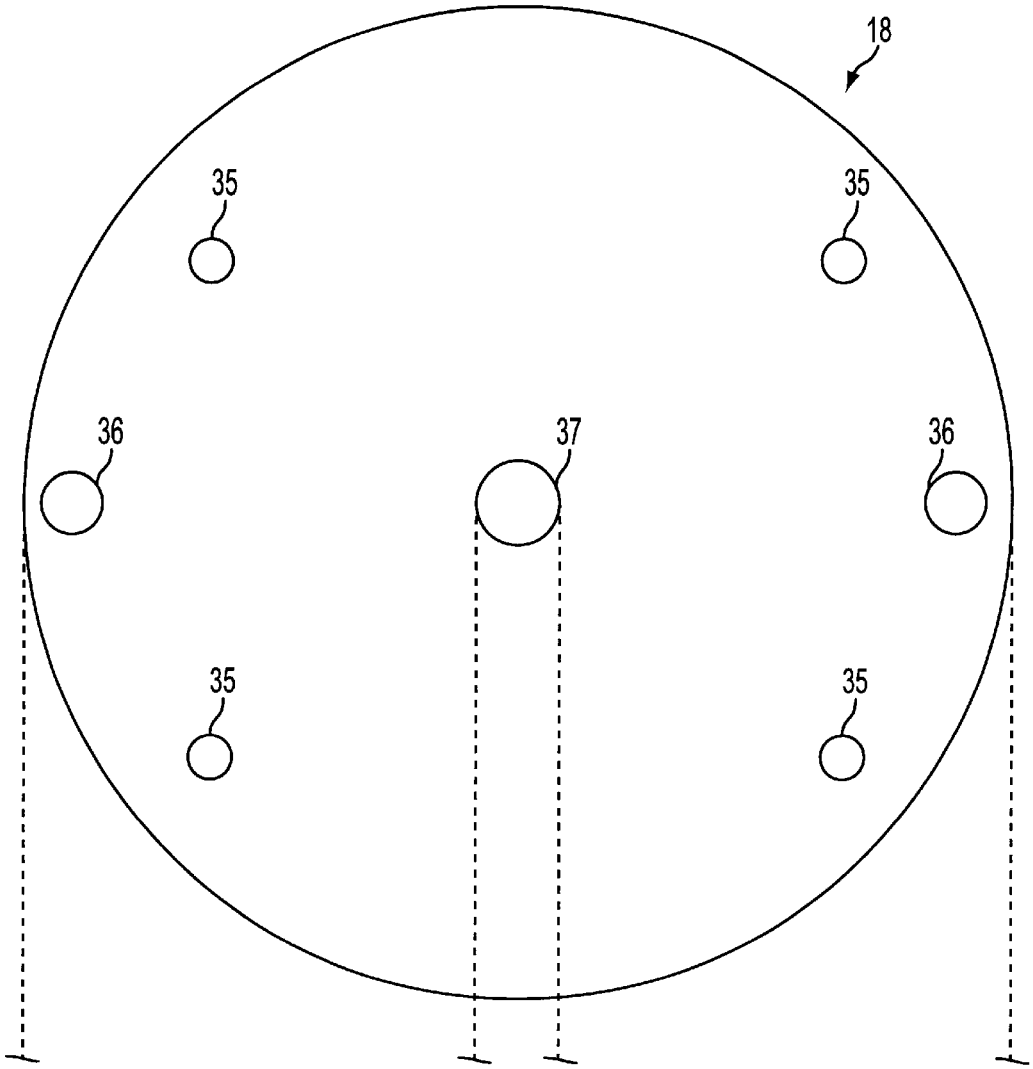
FIG. 12 shows a top view of one of the housing support disks used in the embodiment of FIG. 1 and having four circular threaded bores, symmetrically disposed about a central bore, and showing lateral bores which serve to secure handle bars to the disk.
Figure 13:
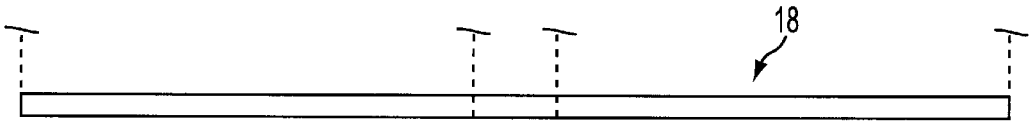
FIG. 13 shows a side lateral view of the disk shown in FIG. 12 with the bores being shown.

FIG. 1 shows two casing support disks 18*a-b*, with one disk 18*a* being disposed adjacent cover 22 and another disk 18*b* disposed adjacent side wall section 20*b*. As shown in FIG. 12, disk 18 has four through apertures 35 which are symmetrically arranged around a central opening 37. Arranged along a center line extending through central opening 37, are two handle rod openings 36. These openings preferably also correspond to the openings 42–44 and 45–47. As with the above-noted elements, disks 18 may be made of metal, plastic, a composite material, or any convenient material which is suitable for the purpose of supporting the handles 17. Of course, it is not critical that the disks be utilized. The invention also contemplates an embodiment which does not utilize the disks 18, e.g., with the side wall section 20*b* and cover 22 themselves serving to support the handles 17.

Figure 2:
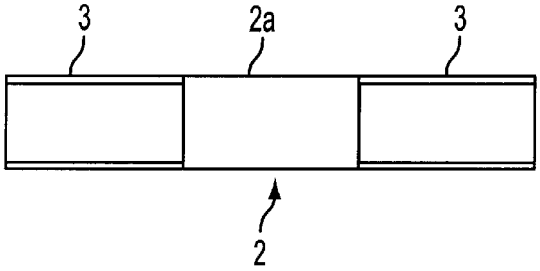
FIG. 2 shows the central axle of the embodiment of FIG. 1 having threaded opposite end portions.

FIG. 1 also shows a central axle 2 having a central cylindrical portion 2*a* and threaded ends 3 (see also FIG. 2). Central axle 2 extends through the casing 19 and connects side wall section 20*b* and cover 22. Rotatably mounted to the axle 2 is a yoke 4 which couples a first weight 12 via a first bar 11 to the central axle 2 in the region of the cylindrical portion 2*a*. Also rotatably mounted on the axle 2 is a spigot 5 which couples a second weight 12' via a second bar 11', similar to the first bar 11, to the central axle 2 in the region of the cylindrical portion 2*a*. The central axle 2 may be made of metal, plastic, a composite material, or any convenient material which is suitable for the purpose of securing the cover 22 to the casing 19 and which is suitable for providing support for the rotating weights 12, 12', bars 11, 11', yoke 4, and spigot 5.

Figures 3, 4:
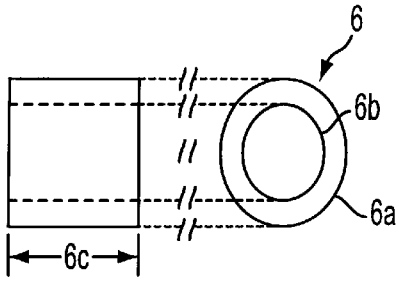
FIG. 3 shows a lateral side view of a bushing having a cylindrical bore used in the embodiment of FIG. 1.
FIG. 4 shows a top view of the bushing shown in FIG. 3.

A main bushing 6 made of suitable material such as, e.g., bronze and/or polytetrafluoroethylene or the like, is preferably used on central axle 2 in the region of the cylindrical portion 2*a*. FIGS. 3 and 4 show main bushing as being cylindrical in shape and including an outside diameter 6*a*, and an inside diameter 6*b* characterized by a through opening which extends throughout the entire length 6*c*. The inside diameter 6*b* is sized to fit, with a tight and/or interference fit over and onto the cylindrical portion 2*a* of central axle 2. A tight and or interference fit is preferably utilized between the inside diameter 6*b* of the main bushing 6 and the cylindrical portion 2*a* of the central axle 2 so that the main bushing 6 does not rotate and or move with respect to the central axle 2. Accordingly, this allows the spigot 5 and yoke 4 to rotate with respect to the outside diameter 6*a* of the main bushing 6 with reduced friction, e.g., the inside diameter 7*b* of the respective bushings 7 of both the spigot 5 and yoke 4, rotates against the outside diameter 6*a* of main bushing 6. The outside diameter 6*a* is sized to fit, with an appropriate clearance, within openings 7*b* in each of the spigot 5 (see FIG. 6) and the yoke 4 (see FIG. 8). The length 6*c* is preferably substantially equal to the width 4*e* (see FIG. 8) of the yoke 4 so that it can provide appropriate support and friction reduction to each of the rotating yoke 4 and spigot 5 about the central axle 2.

Figure 5:
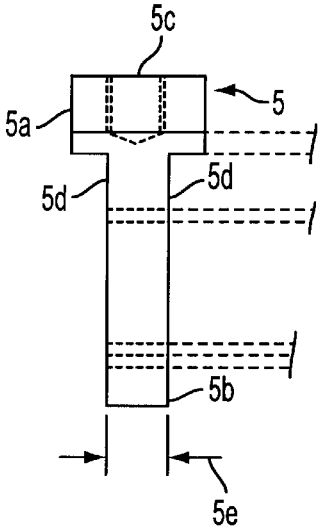
FIG. 5 shows a front side view of an attachment spigot used in the embodiment of FIG. 1 and provided with a bushing, a cylindrical bore, and a threaded blind hole.
Figure 6:
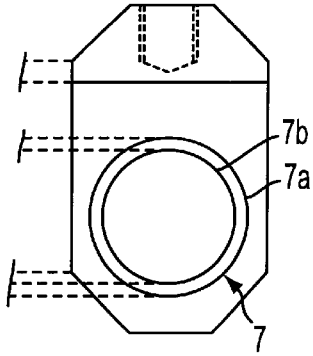
FIG. 6 shows another side view of the spigot illustrated in FIG. 5.

Turning now to FIGS. 5 and 6, the spigot 5 acts to rotatably couple and/or connect the bar 11' and weight 12' to the cylindrical portion 2*a* of central axle 2. Spigot 5 has a bar attaching end 5*a* and a narrower axle attaching end 5*b* defined by parallel guide surfaces 5*d*. Disposed in the bar attaching end 5*a* is a threaded opening 5*c* which has internal threads for engaging external threads 30 of the bar 11'. Spigot 5 also utilizes a bushing 7 which is disposed in the narrower axle attaching end 5*b*. Bushing 7 has an outside diameter 7*a* which is sized with a tight or interference fit within the opening of the narrower axle attaching end 5*b*. Additionally, the cylindrical length of the bushing 7 is preferably substantially equal to the width 5*e* (see FIG. 5) of the axial attaching end 5*b* so that it can provide appropriate support and friction reduction to the rotating spigot 5 about the central axle 2.

Figure 7:
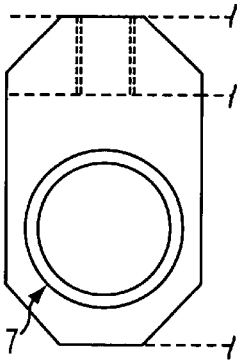
FIG. 7 shows a lateral side view of an attachment yoke used in the embodiment of FIG. 1, having a bushing, a cylindrical bore, and a threaded opening.
Figure 8:
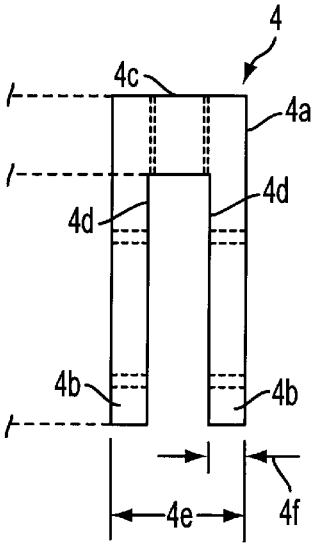
FIG. 8 shows another side view of a yoke used in the embodiment of FIG. 1, having a bushing, a cylindrical bore, and a threaded opening, with parallel plate members being also shown.

As shown in FIGS. 7 and 8, the yoke 4 acts to rotatably couple and/or connect the bar 11 and weight 12 to the cylindrical portion 2*a* of central axle 2. The yoke 4 also has a bar attaching end 4*a* and two parallel arranged axle attaching ends 4*b* defined by a groove with parallel guide surfaces 4*d*. Disposed in the bar attaching end 4*a* is a threaded opening 4*c* which has internal threads for engaging external threads 30 of the bar 11. Yoke 4 also utilizes two bushings 7 which are each disposed in each of the two parallel arranged axle attaching ends 4*b*. As with the spigot 5 above, bushings 7 have an outside diameter 7*a* which is sized with a tight or interference fit within respective openings of each of the two parallel arranged axle attaching ends 4*b*. Additionally, the cylindrical length of each of the bushings 7 is preferably substantially equal to the widths 4*f* of each of the two parallel arranged axle attaching ends 4*b* (see FIG. 8) so that it can provide appropriate support and friction reduction to the rotating yoke 4 about the central axle 2. It should be noted that the width of the groove defined by the two parallel surfaces 4*d* substantially corresponds to the width 5*e* of the axle attaching end of the spigot 5. Of course, there should be a clearance between these so that the yoke surfaces 4*d* can slide with respect to the spigot surfaces 5*d* when the exercise device is utilized.

Figure 9:
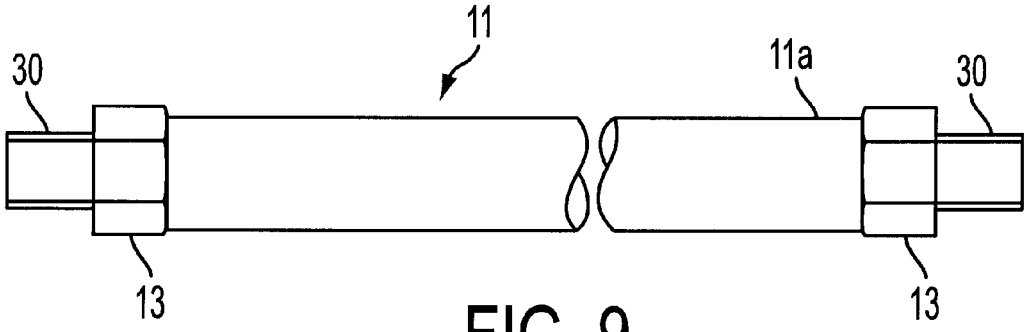
FIG. 9 shows a lateral side view of one of the weight connecting bars used in the embodiment of FIG. 1, having opposite threaded ends and securing nuts.

With reference to FIG. 9, the bars 11 and 11' which connect the weights 12, 12' to their respective yoke 4 and spigot 5 will now be described. Each bar 11, 11' includes an elongated cylindrical section 11*a* and adjustable thread attaching ends which utilize an externally threaded end 30 and an adjusting nut 13. This type of bar design allows for a length of the bars to be made adjustable. This can be important in order to ensure that the weights 12, 12' contact or impact one another symmetrically and/or in the area of their center of mass. Such adjustment is facilitated by loosening each nut and moving the threaded end 30 either into or out from the cylindrical section 11*a*. It should be noted, however, that these bars 11, 11' need not be made adjustable. Moreover, it is not critical that the bars 11, 11' have externally threaded ends 30 while the weights 12, 12' and spigot 5 and yoke 4 have internally threaded ends. The invention also contemplates bars having internally threaded ends with the weights, spigot, and yoke having external threaded ends. Furthermore, the invention also contemplates that the bars be connected to the weights, spigot, and yoke by conventional mechanisms other than threads such as, welding, bonding, or the like. Still further, the spigot, bar, and weight and/or the yoke, bar, and weight may each be integrally formed so as to obviate the need for attachments and/or connections.

Of course, each of the spigot 5, yoke 4, and bars 11, as with the other devices described above, may be made of metal, plastic, a composite material, or any convenient material which is suitable for this purpose.

Figure 10:
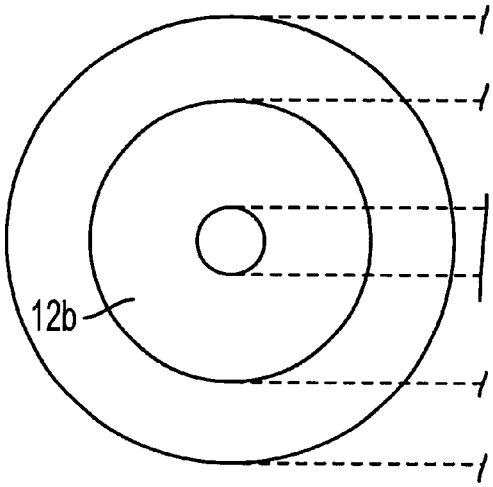
FIG. 10 shows an end view of one of the weights used in the embodiment of FIG. 1, having a threaded blind hole and a flat circular surface.
Figure 11:
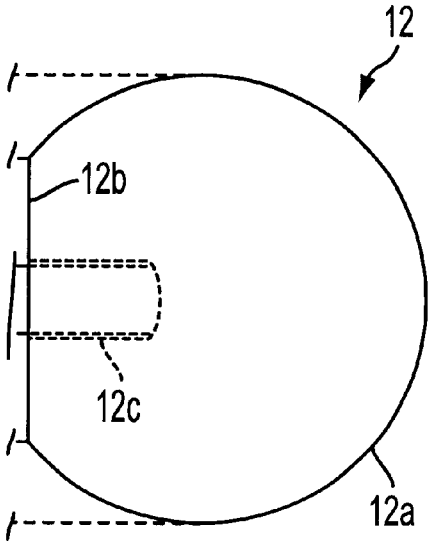
FIG. 11 shows a side view of the weight of FIG. 10 illustrating a truncated sphere with a threaded opening and a flat circular surface also being shown.

With reference to FIGS. 10 and 11, the weights 12 and 12' which are connected to their respective yoke 4 and spigot 5 via bars 11, 11' will now be described. Each T weight 12, 12' includes a spherical portion 12*a*, a flattened portion 12*b*, and an internally threaded section 12*c* which engage the external threaded ends 30 of the bars 11, 11' . As described above, the weights 12, 12' are designed to contact or impact one another symmetrically and/or in the area of their center of mass. Moreover, as described above, it is not critical that the bars 11, 11' have externally threaded ends 30 while the weights 12, 12' and spigot 5 and yoke 4 have internally threaded ends. The invention also contemplates bars having internally threaded ends with the weights, spigot, and yoke having external threaded ends. Furthermore, the invention also contemplates that the bars be connected to the weights, spigot, and yoke by conventional mechanisms other than threads such as, welding, bonding, or the like. Still further, the spigot, bar, and weight and/or the yoke, bar, and weight may each be integrally formed so as to obviate the need for such attachments and/or connections. The weights 12, 12', as with the other devices described above, may be made of metal, plastic, a composite material, or any convenient material which is suitable for this purpose. However, it is preferred that the weights be made of a resilient material since they will be exposed to repeated impact from each other.

Figure 14:
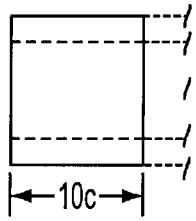
FIG. 14 shows a lateral view of one of the bushing washers having a cylindrical bore used in the embodiment of FIG. 1.
Figure 15:
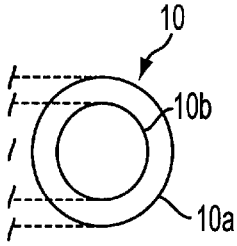
FIG. 15 shows a top view of the bushing washer shown in FIG. 14.

Two thrust bushings 10, made of suitable material such as, e.g., bronze and/or polytetrafluoroethylene or the like, are preferably used on central axle 2 in the region of the cylindrical portion 2*a*. FIGS. 14 and 15 show one such bushing 10 as being cylindrical in shape and including an outside diameter 10*a*, and an inside diameter 10*b* characterized by a through opening which extends throughout the entire length 10*c*. The inside diameter 10*b* is sized to fit, with preferably some amount of clearance, over and onto the cylindrical portion 2*a* of central axle 2. A tight and/or interference fit is required between the inside diameter 10*b* of the bushing 10 and the cylindrical portion 2*a* of the central axle 2. Accordingly, FIG. 1 shows that two of these bushings 10 are used to ensure that the spigot 5 and yoke 4 are centrally located within casing 19. Moreover, these bushings 10 preferably frictionally engage the ends of the main bushing 6 so as to allow the spigot 5 and yoke 4 to rotate with respect to the main bushing 6 and casing 19. These bushings 10 also act as spacing washers to position and/or allow the weights 12, 12', bars 11, 11', spigot 5, and yoke 4 to rotate centrally within the casing 19. The length 10*c* of each bushing 10 is preferably substantially approximately equal to each other. However, it is not necessary that each bushing 10 which is disposed on each side of the , e.g., yoke 4, have the same length 10*c*.

Figure 16:
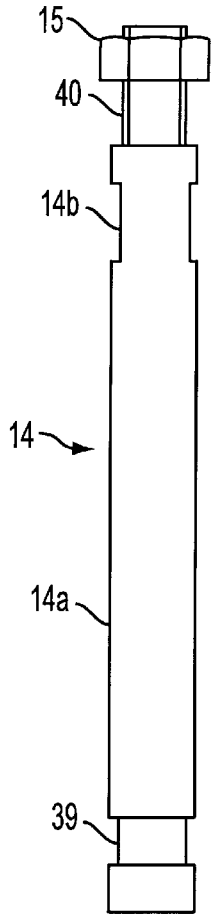
FIG. 16 shows a lateral side view of one of handle support rods used in the embodiment of FIG. 1 having a circular recess at one end and a threaded opposite end that engages a nut.

With reference to FIG. 16, the exerciser 1 uses four handle rods 14 which connect the two handles 17 to a respective side of the exerciser 1. On one side of the exerciser 1, the cover 22 has attached thereto two of these handle rods 14 and on the other side, the side wall section 20*b* of the casing 19 has two similar handle rods 14. These handled rods 14 are utilized to secure gripping handles 17 to the exerciser 1. In this regard, each handle rod 14 has a handle engaging end characterized by a reduced diameter portion 39 which cooperates with handle screw 16 as will be more clearly described later on. Each handle rod 14 also includes an elongated cylindrical section 14*a* and an exerciser attachment end characterized by opposed flats 14*b* and an externally threaded portion 40. This threaded portion 40 is designed to engage corresponding threads on a nut 15. Such handle rods are designed to be secured to the exerciser via the exerciser attachment end using the nuts 15. As discussed previously, the threaded ends 40 are designed to pass through the cover 22 and casing support disk 18*a* on one side of the exerciser, and to pass through the sidewall section 20*b* of casing 19 and casing support disk 18*b* on the other side of the exerciser. Additionally, although such is not shown, it should be noted that the invention contemplates that these handle rods can be made adjustable so as to allow the handles 17 to be positioned either closer or further away from the corresponding sides of the exerciser 1. This can be particularly useful in adapting the exerciser to a particular user's comfort. Moreover, it is not critical that the handle rods 14 have externally threaded ends 40 while the cover 22 or disk 18*a* and/or sidewall section 20*b* or disk 18*b* have openings, e.g., 36, 43 and 47. The invention also contemplates handle rods 14 having internally threaded ends with the cover 22 or disk 18*a* and/or sidewall section 20*b* or disk 18*b* have externally threaded projecting ends. Furthermore, the invention also contemplates that the handle rods be connected to the exerciser 1 by conventional mechanisms other than threads such as, welding, bonding, or the like. Still further, the handle rods 14 and cover 22 and/or sidewall section 20*b* may each be integrally formed so as to obviate the need for such attachments and/or connections. Of course, these handle bars 14, as with the other devices described above, may be made of metal, plastic, a composite material, or any convenient material which is suitable for its purpose.

Figure 17:
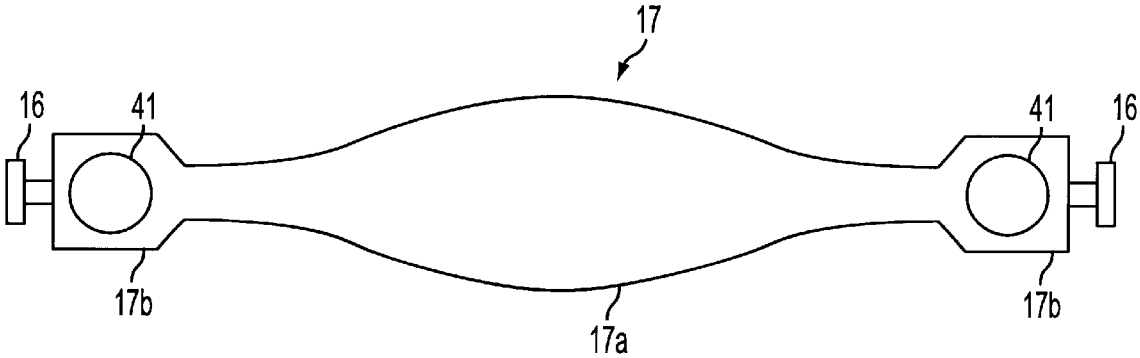
FIG. 17 shows a lateral view of one of the handles used in the embodiment of FIG. 1, with a lateral screw at each end and through-bores adapted to receive the handle support rods such that lateral screws engage the circular recess of the handle support rod.

As described above and with reference to FIG. 17, the exerciser 1 uses two handles 17 which are each connected via two handle rods 14 to a respective side of the exerciser 1. These handles 17 are utilized by the user for gripping the exerciser 1. In this regard, each handle 17 has a handle rod engaging end 17*b* and is characterized by through openings 41 which are sized, with a clearance, to fit over the cylindrical section 14*a* of the handle rods 14. Each handle 17 has a central hand gripping section 17*a* which has an enlarged middle section which gradually tapers down to the ends 17*b*. Such a design facilitates gripping by the user. However, the invention also contemplates other handle designs which may be more or less ergonomic. Additionally, the handle may include mechanisms for facilitating gripping such as, e.g., texturing, and/or knurling, and/or friction coatings, and/or soft rubber grips. Each handle 17 preferably is removable. This is facilitated via handle screws 16 which engage reduced diameter portion 39 of handle rods 14. Moreover, it is not critical that the handles 17 have through openings 41 while the handle rods 14 have cylindrical ends with reduced diameter portions 39. The invention also contemplates handles 17 having externally threaded projecting ends which engage internally threaded ends of the handle rods 14. Furthermore, the invention also contemplates that the handles 17 be connected to the exerciser 1 by conventional mechanisms other than openings 41, reduced diameter portion 39, and handle screw 16, such as, welding, bonding, or the like. Still further, the handles 17 and handle rods 14, or the handles 17 and handle rods 14 and cover 22 and/or sidewall section 20*b* may each be integrally formed so as to obviate the need for such attachments and/or connections. Of course, these handles 17, as with the other devices described above, may be made of metal, plastic, a composite material, or any convenient material which is suitable for this purpose.

Turning now to FIG. 1, the assembly of the exerciser 1 will be described. The casing 19 is initially sub-assembled with the disk 18*b* being retained thereto via two handle rods 14. In this regard, each of the two handle rods 14 is inserted threaded end 40 first into openings 47 in sidewall section 20*b*. Next, disk 18*b* is positioned within the casing 19 and against the inside surface of the sidewall section 20*b* with the threaded ends 40 of the handle rods 14 projecting through openings 36 of the disk 18*b*. Then the disk 18*b* can be secured to the sidewall section 20*b* via openings 35 and apertures 46; the disk 18*b* and sidewall section 20*b* being connected with small fasteners, screws, or the like.

The cover 22 can then be initially sub-assembled as well with the disk 18*a* being retained thereto again via two handle rods 14. In this regard, each of the two handle rods 14 is inserted threaded end 40 first into openings 43 in cover 22. Next disk 18*a* is positioned against the inside surface of the cover 22 with the threaded ends 40 of the handle rods 14 projecting through openings 36 of the disk 18*a*. Then the disk 18*a* can be secured to the cover 22 via openings 35 and apertures 42; the disk 18*a* and cover 22 being connected with small fasteners, screws, or the like.

Next, the weight system can be sub-assembled as follows. Firstly, the main bushing 6 is pressed onto the central axle 2 in a central position over the cylindrical portion 2*a*. Then, each of the spigot 5 and yoke 4 receives its bushing(s) 7 which are similarly pressed into the openings (see FIGS. 5–8). The spigot 5 next receives a threaded end 30 of bar 11' into threaded opening 5*c*, with the weight 12' being threaded onto the other end 30 of the bar 11'. The yoke 4 similarly receives a threaded end 30 of bar 11 into threaded opening 4*c*, with the weight 12 being threaded onto the other end 30 of the bar 1. Each weight sub-assembly 12/11/4 and 12'/11'/5 is next assembled onto the central axle 2 over the main bushing 6. Following this, a thrust bushing 10 is placed on each side of the central axle 2.

The weight system is then assembled first to the sidewall section 20*b* of the casing 19 as follows. One end of the threaded end 3 of the central axle 2 is passed through openings 37 and 45 or the disk 18*b* and sidewall section 20 respectively. Thereafter, a washer 9 is slid onto the threaded end 3 and then a nut 8 is tightened to secure the weight system to the sidewall section 20*b* of the casing 19. Next, the other threaded end 3 of the central axle 2 is passed through openings 37 and 44 or the disk 18*a* and cover 22 respectively. Thereafter, a washer 9 is slid onto the threaded end 3 and then a nut 8 is tightened to secure the cover 22 to the weight system and the casing 19.

Finally, the handles 17 are positioned over their respective handle rods 14 and retained thereon via tightening of the handle screws 16.

Figure 21:
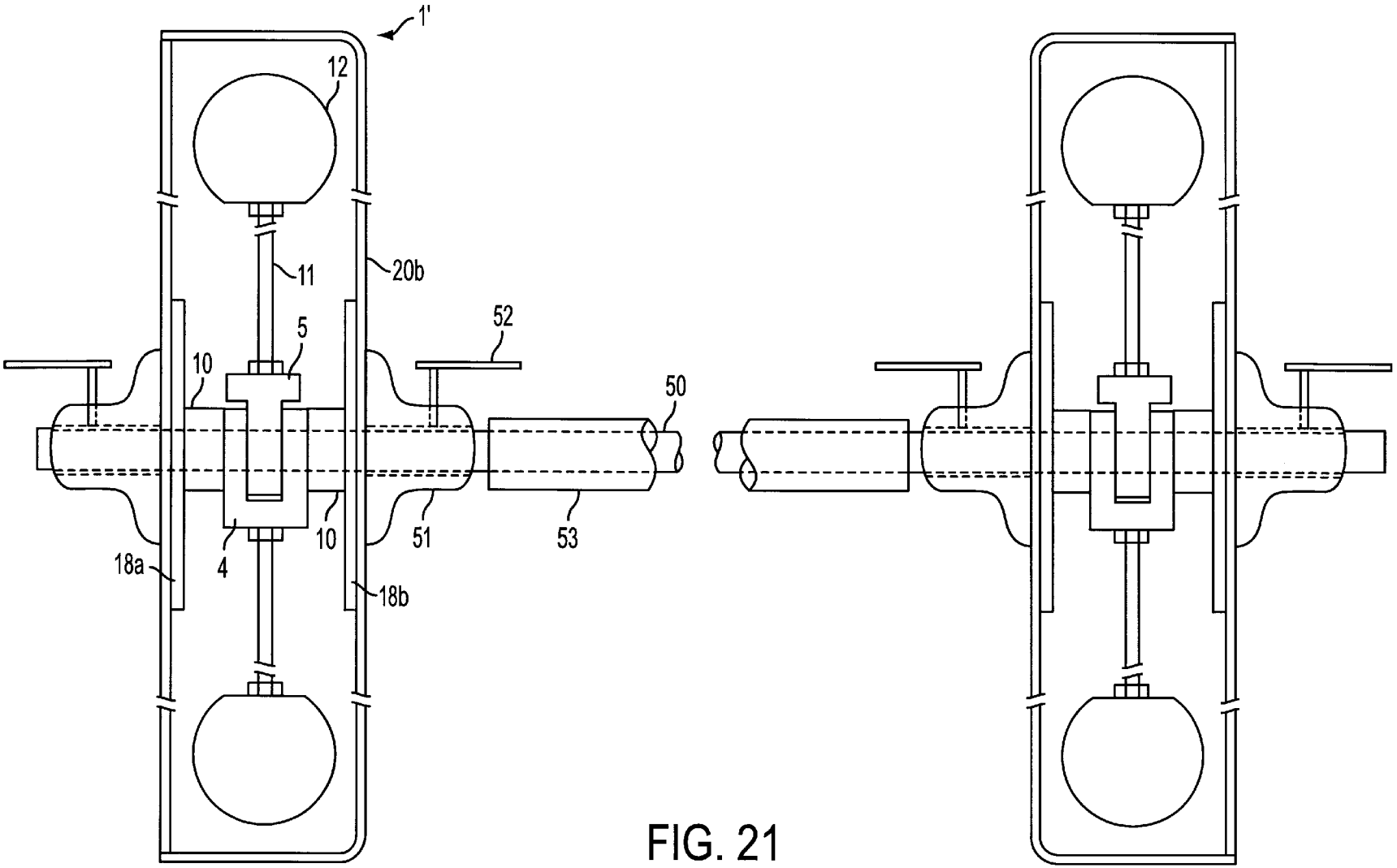
FIG. 21 shows a lateral side view of another embodiment of an exerciser.

Another advantageous embodiment of the exerciser is shown in FIG. 21. This embodiment is characterized as having many similar features to the embodiment just described. Accordingly, common reference numbers have been used to designate the similar features. In this regard, this embodiment uses two or more similar exercisers 1' which are disposed on a bar 50 so as to resemble a barbell type device, e.g., a bar having weights on two of its ends and a center area for gripping by the user. In this case, the typical weights are replaced by the exercisers 1' of the invention.

The exerciser includes two exerciser modules 1' having weights 12, bars 11, a yoke 4, a spigot 5, and disks bushings 10. Each module is mounted on a central shaft 50, on which is rotatably mounted an external tube 53 which is of a slightly larger diameter than central shaft 50. Each module 1' is retained on the central shaft 50 via two retaining elements 51 which utilize a locking threaded key member 52.

These retaining elements 51 maintain the external casing, properly assembled, with the casing cover fitting into an internal recess of the casing body.

Figure 24:
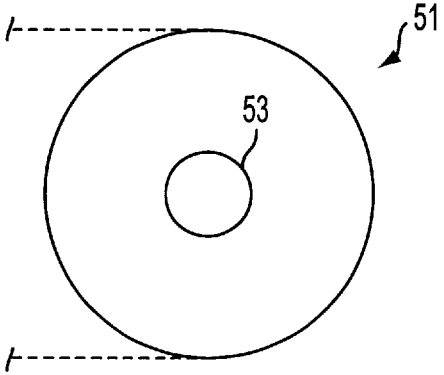
FIGS. 23 and 24 show a lateral side and a front view, respectively, of retaining elements in which a central cylindrical bore and a locking or securing key are shown.
Figure 23:
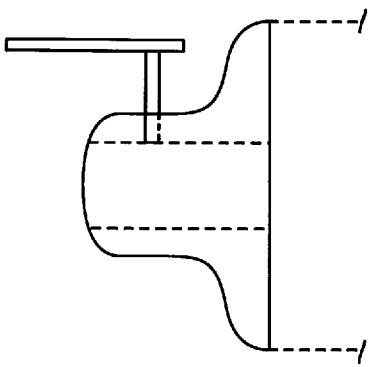

Accordingly, FIG. 21 shows a bar 50 which may be covered by a gripping surface and/or a gripping sleeve 53. Disposed on each end of the bar 50 is one or more exercisers 1' which are retained thereon via retaining sleeves 51. Unlike the previous embodiment, this embodiment does not utilize a central axle 2. Instead, the bar 50 acts as the central axle in that it rotatably supports the weight system, cover 22 and casing 19. In this regard, each exerciser 1' is removably disposed on each end of the bar via two retaining sleeves 51 (See FIGS. 23 and 24). Moreover, these retaining sleeves 51 are secured to the bar via locking fasteners 52 which are threaded into openings in the retaining sleeves 51. Further, these sleeves 51 have through openings 53 which are sized to fit, with a clearance, over the outside diameter 50*a* of the bar 50. Accordingly, the exercisers 1 are designed to be removable. However, the invention also contemplates that these exercisers 1' be integrally formed on the ends of the bar 50 and/or permanently attached thereto.

Figure 22:
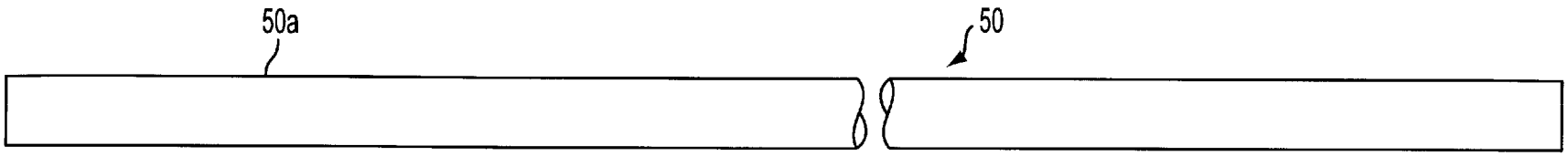
FIG. 22 is a lateral side view of a central shaft used in the embodiment of FIG. 21.

As seen in FIG. 22, the bar 50 is an elongated cylindrical rod or tube which preferably has sufficient strength to support two or more exercisers 1'. Accordingly, bar 50 may be a solid bar or a tube. Of course, the bar 50, as with the other devices described above, may be made of metal, plastic, a composite material, or any convenient material which is suitable for its purpose.

Figure 25:
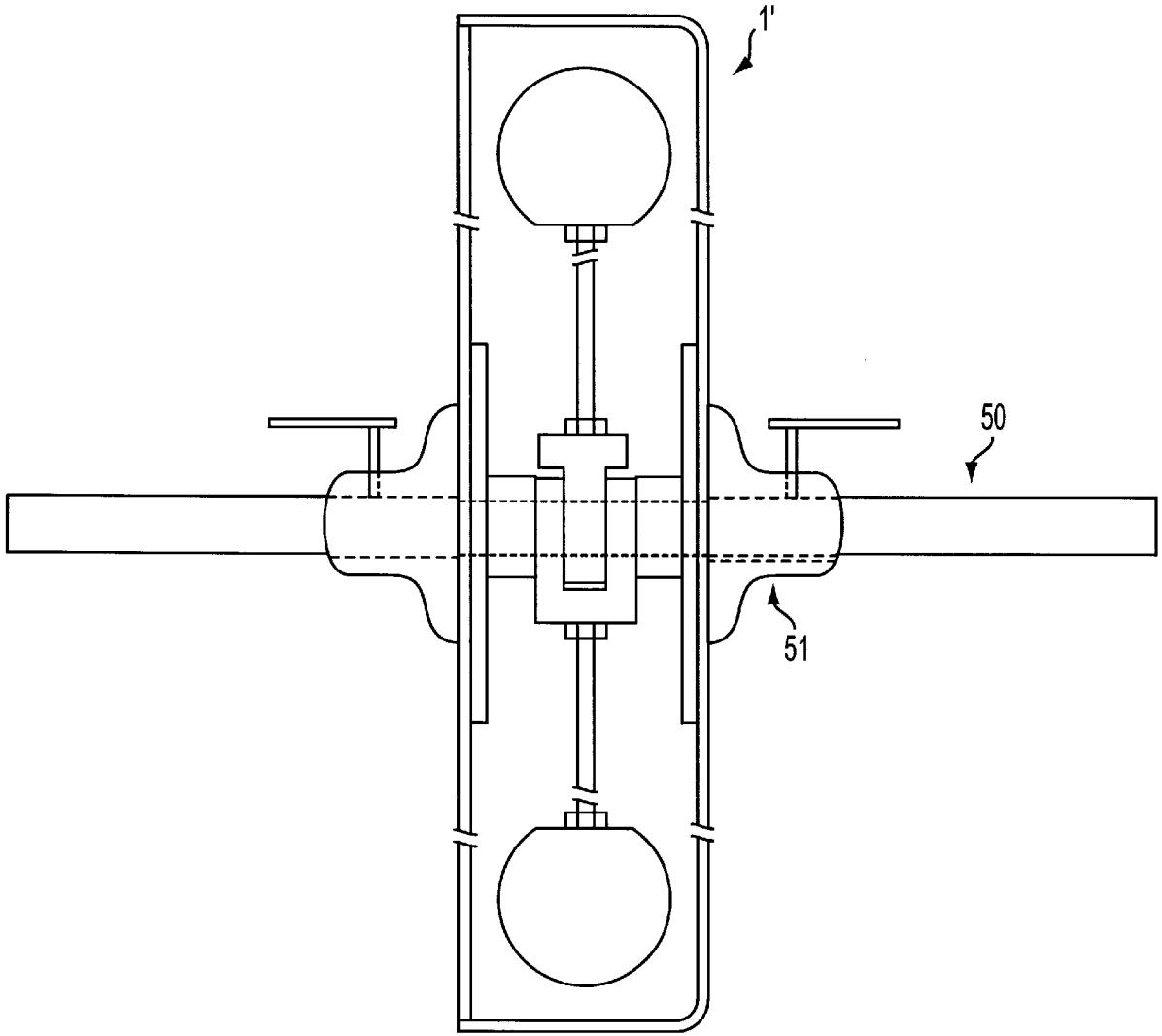
FIG. 25 shows another embodiment of an exerciser in which a relatively short central bar or shaft is utilized to support a single exerciser module which is retained via two retention elements and wherein the extremes of the shaft can be used as handles.
Figure 26:
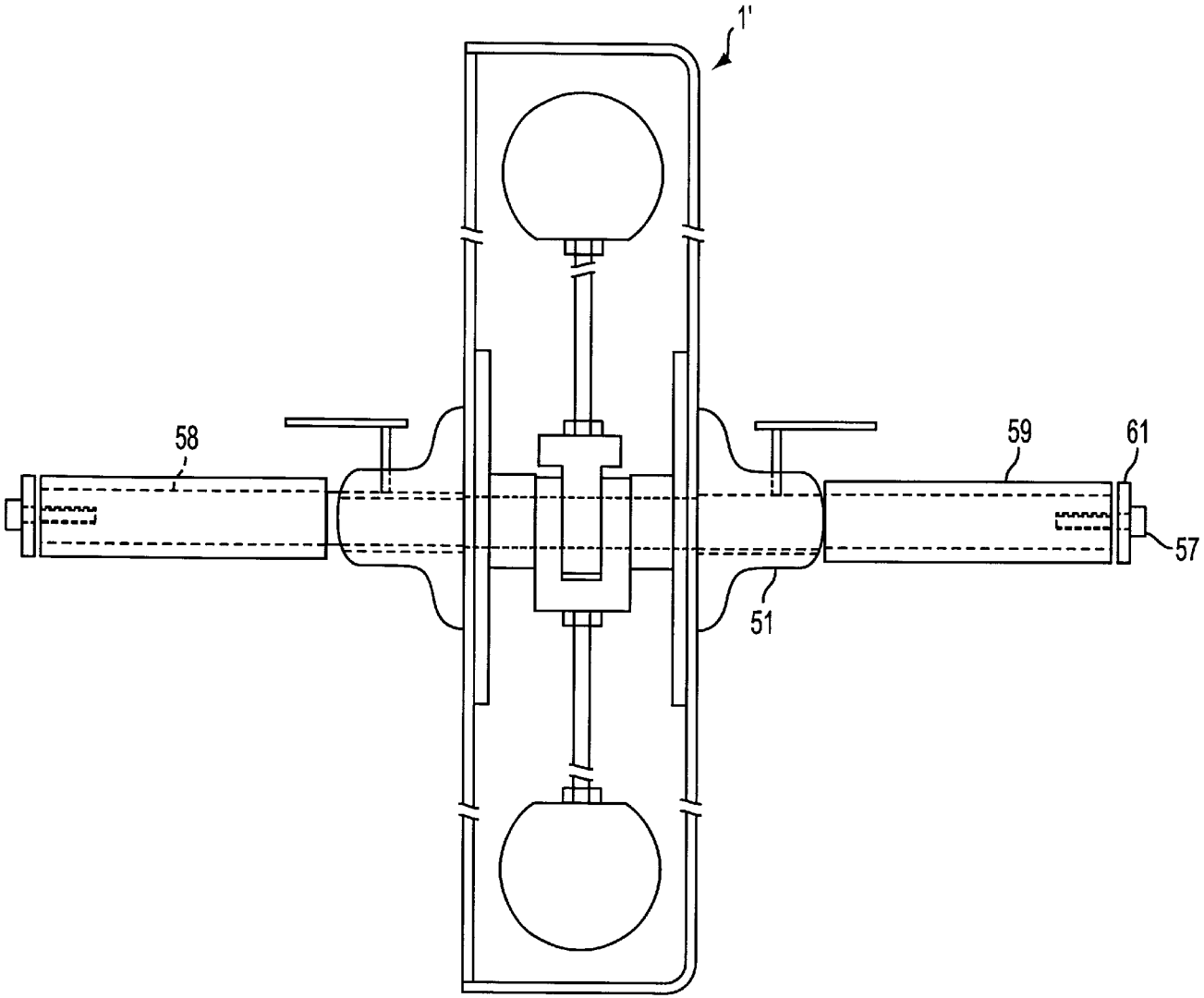
FIG. 26 shows another embodiment of an inertial exerciser somewhat similar to the exerciser shown in FIG. 25, but including lateral tubes which are rotatably mounted on a shaft.

Other advantageous embodiments of the exerciser are shown in FIGS. 25 and 26. These embodiments are characterized as having many similar features to the embodiment just described, accordingly common reference numbers have been used to designate the similar features. In this regard, this embodiment uses one or more similar exercisers 1' which are centrally disposed on a bar 50 so as to resemble a single weight barbell type device, e.g., a bar having weights disposed at the center of a bar with free ends for gripping by the user. In this case, the typical weight(s) are replaced by the exerciser(s) 1' of the invention.

Accordingly, each of FIGS. 25 and 26 show a bar 50 which may (see FIG. 26) or may not be covered by a gripping surface and/or a gripping sleeve 53. Disposed at the approximate center of the bar 50 are one or more exercisers 1' which are retained thereon via retaining sleeves 51. Again, unlike the first embodiment, this embodiment does not utilize a central axle 2. Instead, the bar 50 acts as the central axle in that it rotatably supports the weight system, cover 22 and casing 19. In this regard, each exerciser 1' is removably disposed at the center of the bar via two retaining sleeves 51 (See FIGS. 23 and 24). Moreover, these retaining sleeves 51 are secured to the bar via locking fasteners 52 which are threaded into openings in the retaining sleeves 51. Further, these sleeves 51 have through openings 53 which are sized to fit, with a clearance, over the outside diameter 50*a* of the bar 50. Accordingly, the exerciser(s) 1' are designed to be removable. However, the invention also contemplates that these exercisers 1' are integrally formed with the bar 50 and/or permanently attached thereto.

Again, the bar 50 in this embodiment may be an elongated cylindrical rod or tube which preferably has sufficient strength to support two or more exercisers 1'. Accordingly, bar 50 may be a solid bar or a tube. Of course, the bar 50, as with the other devices described above, may be made of metal, plastic, a composite material, or any convenient material which is suitable for this purpose.

The embodiment of FIG. 26 shows the additional use of gripping sleeves 59 which are retained by washers 61 and fasteners 57. Of course, the sleeve 59 in this embodiment may be any convenient material or tube which preferably has an exterior surface facilitating gripping by the user.

As discussed above, in all the embodiments, the weights 12 may be made of steel or plastic material, but they are preferably made of acrylic and may preferably have the shape of a truncated sphere.

Turning now to the operation of the exerciser, the user can grasp the handles 17 or the bar 50 with both hands depending on the particular embodiment used. Alternatively, the user may grasp a single handle 17 or the bar with one hand depending on the embodiment. Next, the user imparts to the device a movement which may be in any number of directions such as, e.g., substantially vertical or horizontal, linear, or circular reciprocating motion. A substantially orbital or circular continuous motion can also be imparted to the exerciser, as well as to the various embodiments shown and described herein. Depending, on the motion imparted to the exercisers, the weights 12 within the casings 19 are caused to move with a circular reciprocating motion and eventually collide with one another at the end of each half cycle or move together with a circular continuous motion. Accordingly, such motion gives the user of the exerciser a unique exercise experience which is different from that of conventional exercisers.

Inertial exercisers 1' shown in FIG. 21, 25 and 26 can be used in a similar manner as exerciser 1. Additionally, they can be rolled in a substantially flat surface, external casings 19 serving, as wheels. As a particular example, the diameter of the external casing, may be of about 1 meter, so that the user can impart an horizontal linear reciprocating motion to exerciser 1' , while standing and holding, with one or both hands, external tube 53. Of course, the size of exerciser 48 may vary according to the type of exercise to be performed; it can be used as a dumbbell or a barbell. More exercise modules 1' (e.g. four, two in each side), may be mounted on a central shaft 50, which may be as long as needed. Additionally, the exerciser 1' of FIGS. 25 and 26 may use a relatively short central bar or shaft, on which single exerciser module 1', is mounted and retained thereon with the lateral supports. Of course, exerciser module 1', may be mounted at any segment of shaft; the middle position is preferred insofar as the weight is evenly distributed and the extremes of the shaft can be used as handles. In the embodiment of FIG. 26, the inertial exerciser is very similar to the exerciser of FIG. 25. The only difference is that it is provided with lateral tubes 59, rotatably mounted on shaft 58, which in turn, is endowed with threaded ends, where distal screws 57 are screwed, for the purpose of keeping lateral tubes or handles 59. in position over central bar or shaft 58. Thus, this inertial exerciser embodiment may also be rollable over a substantially flat, preferably horizontal surface.

Figure 27:
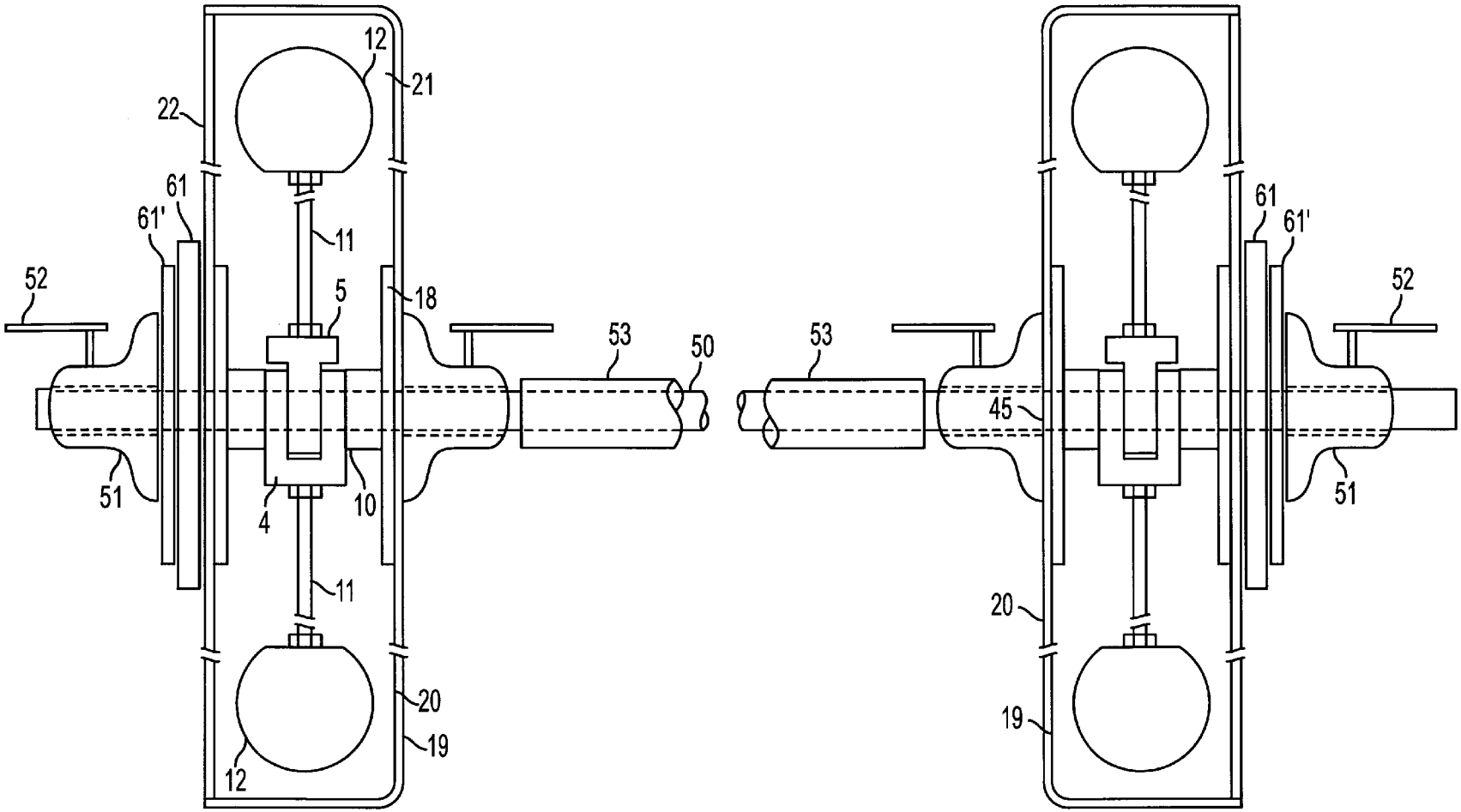
FIG. 27 shows still another inertial exerciser which is somewhat similar to the exerciser shown in FIG. 21 except that it is additionally provided with standard weights which are retained by retention elements on the central shaft.

Finally, the embodiment of FIG. 27 represents still another inertial exerciser device which is similar to the exerciser shown in FIG. 21, except that it additionally includes one or more standard weights 61, 61', that may be inserted laterally adjacent the exercisers 1' onto the bar 50 in the area, e.g., between the cover 22 of the casing 19 and the retaining sleeve 51. Of course, such weights 61, 61' can also be used on any of the other embodiments as well.

It should be noted that the invention, in all embodiments, is not limited to a circular casing 19. Other shapes are also contemplated such as, e.g., square, polygonal, oval, or the like, as long as such shapes allow the weights to move within the casing in a similar fashion. Moreover, the casing 19 need not be made with solid surfaces. Accordingly, it may have many openings to allow the user to view the weights moving within—a feature which may be particularly advantageous when the casing is made of a material which is not at least partially transparent.

It should also be noted that in all variants of the invention, the partially spherically shaped weights may be made of any suitable plastic material, iron, steel or other metals. The casings of the variations may be made of transparent plastic material or any other suitable material. Moreover, the casing and materials used may be colored in any color desired by the user and/or may have any desired exterior embossments and/or indentations and may even include advertisements and various indentations for containing such advertisements. When any lighter weight material is used for the casinos structural metal reinforcements may be used. Such reinforcement material may be applied either integrally or separately to the casing material.

It is noted that the foregoing disclosure has been provided merely for the purpose of explanation and is in no way to be construed as limiting of the present invention. While the present invention has been described with reference to at least one preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent strictures, methods and uses, such as are within the scope of the appended claims.

What is claimed is:

1. An inertial exerciser, comprising:

at least one weight system comprising at least a first weight and a second weight, the first and second weights being rotatably mounted;

at least one chamber for at least partial enclosing the weight system; and at least one mechanism for allowing a user to grip the inertial exerciser, wherein the first and second weights are rotatably mounted on an axle.

2. The exerciser of claim 1, wherein the mechanism for gripping comprises at least one handle.

3. The exerciser of claim 1, wherein the first and second weights comprise a partially spherical shape.

4. The exerciser of claim 1, wherein the first and second weights are attached to the axle via respective first and second connecting bars.

5. The exerciser of claim 1, wherein the first connecting bar is coupled to the axle via a yoke and wherein the second connecting bar is coupled to the axle via a spigot.

6. The exerciser of claim 5, further comprising at least one bushing disposed between at least one of the axle and the yoke and the axle and the spigot.

7. The exerciser of claim 5, further comprising at least one thrust bushing disposed on the axle adjacent at least one of the yoke and the spigot.

8. The exerciser of claim 5, wherein one of the first and second connecting bars is adjustable.

9. The exerciser of claim 1, wherein the chamber further comprises a circular bowl shaped casing.

10. The exerciser of claim 9, wherein the chamber further comprises a circular shaped cover.

11. The exerciser of claim 1, wherein the mechanism for allowing a user to grip the inertial exerciser further comprises a first handle positioned on one side of the exerciser and a second handle positioned on another side of the exerciser.

12. The exerciser of claim 11, wherein one of the first and second handles is secured to the exerciser via at least two handle rods which are attached to the exerciser.

13. The exerciser of claim 12, wherein one of the first and second handles comprises at least one handle screw which are adapted to engage at least one handle rod.

14. The exerciser of claim 11, wherein one of the first and second handles is removable from the exerciser.

15. The exerciser of claim 1, wherein the weight system is secured to the chamber via at least one threaded connection.

16. The exerciser of claim 1, wherein the axle is secured to the chamber via at least one threaded connection.

17. The exerciser of claim 1, wherein the mechanism for gripping comprises a bar.

18. The exerciser of claim 17, further comprising first and second retaining members disposed on the bar for axially retaining the at least one chamber on the bar.

19. The exerciser of claim 17, wherein the bar comprises a handle.

20. An inertial exerciser, comprising:

a bar;

at least one weight system comprising at least a first weight and a second weight, the first and second weights being rotatably mounted on the bar; and at least one chamber for at least partial enclosing the weight system, wherein the bar is adapted to allow a user to grip the inertial exerciser.

21. The exerciser of claim 20, further comprising at least one gripping sleeve disposed on the bar.

22. The exerciser of claim 20, wherein the bar comprises a textured gripping surface.

23. The exerciser of claim 20, wherein the first and second weights are attached to the bar via respective first and second connecting bars.

24. The exerciser of claim 23, wherein the first connecting bar is coupled to the bar via a yoke and wherein the second connecting bar is coupled to the bar via a spigot.

25. The exerciser of claim 24, further comprising at least one bushing disposed between at least one of the bar and the yoke and the bar and the spigot.

26. The exerciser of claim 24, further comprising at least one thrust bushing disposed on the bar adjacent at least one of the yoke and the spigot.

27. The exerciser of claim 24, wherein one of the first and second connecting bars are adjustable.

28. The exerciser of claim 20, wherein the chamber further comprises a circular bowl shaped casing.

29. The exerciser of claim 28, wherein the chamber further comprises a circular shaped cover.

30. The exerciser of claim 20, wherein the bar further comprises a first handle end on one side of the exerciser and a second handle end on another side of the exerciser.

31. The exerciser of claim 20, further comprising first and second retaining members disposed on the bar for axially retaining the at least one chamber on the bar.

32. The exerciser of claim 20, further comprising at least one weight disposed on the bar and adjacent the chamber.

33. A method of exercising using an inertial exerciser which comprises at least one weight system comprising at least a first weight and a second weight, the first and second weights being rotatably mounted on an axle, at least one chamber for at least partial enclosing the weight system, and at least one mechanism for allowing a user to grip the inertial exerciser, the method comprising:

gripping the exerciser with at least one hand; and moving the exerciser in at least one direction.

34. A method of exercising using an inertial exerciser which comprises a bar, at least one weight system comprising at least a first weight and a second weight, the first and second weights being rotatably mounted on the bar, and at least one chamber for at least partial enclosing the weight system, the bar being adapted to allow a user to grip the inertial exerciser, the method comprising:

gripping the bar with at least one hand; and moving the exerciser in at least one direction.

35. A method of assembling an inertial exerciser, which includes at least one weight system comprising at least a first weight and a second weight, the first and second weights being rotatably mounted on an axle, at least one chamber for at least partial enclosing the weight system, and at least one mechanism for allowing a user to grip the inertial exerciser, the method comprising:

installing the at least one first weight and the at least one second weight into the at least one chamber; and attaching the at least one mechanism to the at least one chamber.

36. The method of claim 35, further comprising connecting the first and second weights to the axle via respective first and second connecting bars.

37. The method of claim 36, further comprising coupling the first connecting bar to the axle via a yoke and coupling the second connecting bar to the axle via a spigot.

38. The method of claim 37, further comprising installing at least one bushing between at least one of the axle and the yoke and the axle and the spigot.

39. The method of claim 37, further comprising installing at least one thrust bushing on the axle adjacent at least one of the yoke and the spigot.

40. The method of claim 35, wherein the attaching comprises positioning a first handle on one side of the exerciser and a second handle on another side of the exerciser.

41. An inertial exerciser, comprising:

an axle;

at least one weight system comprising at least a first weight and a second weight, the first and second weights being rotatably mounted to the axle;

the first and second weights comprising a partially spherical shape and being attached to the axle via respective first and second connecting bars;

the first connecting bar being coupled to the axle via a yoke and the second connecting bar being coupled to the axle via a spigot;

at least one chamber for at least partially enclosing the weight system; and at least one handle for allowing a user to grip the inertial exerciser.

42. The method of assembling an inertial exerciser, which includes at least one weight system comprising at least a first weight and a second weight, the first and second weights being rotatably mounted, at least one chamber for at least partially enclosing the weight system, and at least one mechanism for allowing a user to grip the inertial exerciser, the method comprising:

installing the at least one first weight and the at least one second weight into the at least one chamber;

attaching the at least one mechanism to the at least one chamber;

rotatably mounting the first and second weights on an axle;

connecting the first and second weights to the axle via respective first and second connecting bars; and coupling the first connecting bar to the axle via a yoke and coupling the second connecting bar to the axle via a spigot.

43. An inertial exerciser, comprising:

at least one weight system comprising at least a first weight and at least a second weight;

the first weight being secured to a radially oriented first connecting bar; and the second weight being secured to a radially oriented second connecting bar, wherein the first and second weights are rotatably mounted about a common axle via the first and second connecting bars.

44. The exerciser of claim 43, wherein the first and second weights rotate about a common plane.

45. The exerciser of claim 43, further comprising a chamber which one of encloses and surrounds the weight system, whereby the weight system is free to move without contacting the chamber.

46. The exerciser of claim 45, wherein the chamber comprises a cylindrical body and a circular cover.

47. The exerciser of claim 43, wherein the first weight is secured to the radially oriented first connecting bar via a yoke and wherein the second weight is secured to the radially oriented second connecting bar via a spigot.

48. A method of exercising using an inertial exerciser which comprises at least one weight system comprising at least a first weight and at least a second weight, the first weight being secured to a radially oriented first connecting bar, and the second weight being secured to a radially oriented second connecting bar, wherein the first and second weights are rotatably mounted about a common axle, the method comprising:

moving the exerciser in at least one direction;

causing the weight system to move in a circular direction; and allowing the first and second weights to contact one another.

49. A method of assembling an inertial exerciser, which includes at least one weight system comprising at least a first weight and at least a second weight, the first weight being secured to a radially oriented first connecting bar, and the second weight being secured to a radially oriented second connecting bar, wherein the first and second weights are rotatably mounted about a common axle, the method comprising:

connecting the first weight to the first connecting bar;

connecting the second weight to the second connecting bar;

mounting the first connecting bar to the axle; and mounting the second connecting bar to the axle.

* * * * *

UNITED STATES PATENT AND TRADEMARK OFFICE

CERTIFICATE OF CORRECTION

PATENT NO. : 6,488,613 B1
DATED : December 3, 2002
INVENTOR(S) : A. Domenge

It is certified that error appears in the above-identified patent and that said Letters Patent is hereby corrected as shown below:

Title page,
Item [57], ABSTRACT,
Lines 2-3, "A method of exercizing, various exercize devices and a method of assembling the exercizer devices" should be -- A method of exercising, various exercise devices and a method of assembling the exerciser devices --.
Line 8, "exercizer" should be -- exerciser --.
Line 9, "exercizing" should be -- exercising --.
Line 10, "exercizer" should be -- exerciser --.

Column 18,
Line 23, "claim 1" should be -- claim 4 --.

Column 20,
Line 28, "The" should be -- A --.

Signed and Sealed this

Ninth Day of September, 2003

JAMES E. ROGAN
*Director of the United States Patent and Trademark Office*